United States Patent [19]

Herb

[11] Patent Number: 4,535,932

[45] Date of Patent: Aug. 20, 1985

[54] ACTUATOR FOR A HEATING/COOLING DIFFUSER

[75] Inventor: Carl C. Herb, Camillus, N.Y.

[73] Assignee: Carrier Corporation, Syracuse, N.Y.

[21] Appl. No.: 619,417

[22] Filed: Jun. 11, 1984

[51] Int. Cl.[3] ..... F24F 13/10

[52] U.S. Cl. ..... 236/49; 74/108; 98/40.17; 98/40.25; 137/468; 137/875; 236/100; 251/294

[58] Field of Search ..... 74/108, 501 R; 98/40 D, 98/41 R, 40 VT; 137/468, 861, 875, 862, 872; 236/49, 99 K, 100, 99 R, 99 F, 99 G; 251/294, 11, 279

[56] References Cited

U.S. PATENT DOCUMENTS

| | | | |
|---|---|---|---|
| 1,956,052 | 4/1934 | Te Pas | 236/99 GX |
| 1,961,325 | 6/1934 | Andersson | 236/99 G |
| 3,739,805 | 6/1973 | Wright | 251/294 X |
| 3,885,770 | 5/1975 | Houk | 251/294 |

FOREIGN PATENT DOCUMENTS

| | | | |
|---|---|---|---|
| 2033194 | 1/1972 | Fed. Rep. of Germany | 98/40 D |
| 1121279 | 7/1956 | France | 137/468 |
| 53-135155 | 11/1978 | Japan | 236/99 K |

*Primary Examiner*—Harold Joyce
*Attorney, Agent, or Firm*—David J. Zobkiw

[57] ABSTRACT

A diffuser is provided with three discharges. Two of the discharges are directed in one direction and, when installed, would be directed towards the outside wall of the conditioned space. The other discharge is directed in the opposite direction and would discharge into the interior of the conditioned space. Responsive to the temperature of the conditioned air being supplied, a thermally responsive actuator is in either one of two positions whereby either one of the two discharges in the one direction or the discharge in the opposite direction is blocked. This results in two discharges in one direction or one in each direction with the discharge area being the same in both instances.

2 Claims, 4 Drawing Figures

ACTUATOR FOR A HEATING/COOLING DIFFUSER

BACKGROUND OF THE INVENTION

In diffusers selectively distributing either warm or cool air, it is common practice to use different discharges for the warm and cool air. In perimeter zones in particular, it is desirable to have heat discharged towards the outside wall while cool air is directed into the space to cool the occupants. Thermoactuators, which are thermostatic devices containing a material which undergoes a reversible phase change with an associated expansion/contraction, are often used to achieve changeover. A typical phase changing material would be a wax-like material which is solid at the supply temperature of the cool air and is liquid at the supply temperature of the warm air. The expansion of the phase changing material in going from the solid to the liquid state provides the mechanical power to achieve changeover, and reset by spring bias upon a reverse phase change.

SUMMARY OF THE INVENTION

The present invention is directed to a thermally responsive actuator for a ceiling diffuser for controlling the air distribution depending upon whether it is distributing warm or cool air. The diffuser provides a two-way discharge, as is desirable for the cooling function, and a one-way discharge having the same total discharge area located so as to direct all of the heating air towards the outside wall. This is achieved by providing a diffuser having two discharges directed toward the outside wall and one directed towards the interior of the conditioned space. One of the two discharges directed toward the outside wall is always open while one of the other two discharges is open and the other closed depending upon the character of the air being discharged. Since the two discharges subject to being opened and closed face in opposite directions and are of equal discharge area, the result is a two-way discharge for cooling and a one-way discharge for heating having the same discharge area. The one-way blow towards the outside wall on heating is the most effective in maintaining room comfort while an equal heating and cooling discharge area is required for heating with low temperature air such as plenum air. While the heating and cooling air volumes are not conventionally the same, the use of low temperature air for heating in this manner with a higher heating volume has been found to provide favorable room comfort and lower heat energy cost. Changeover from one discharge pattern to the other is achieved by converting linear movement of a thermoactuator due to thermal expansion and contraction into rotary movement of a swing baffle by flexure of a rod.

It is an object of this invention to provide an actuator for a heating/cooling diffuser suitable for supplying low temperature air for heating.

It is an additional object of this invention to provide an actuator for converting linear motion to rotary motion. These objects, and others as will become apparent hereinafter, are provided according to the teachings of the present invention.

Basically, the diffuser is provided with three discharges. Two of the discharges are directed in one direction and, when installed, would be directed towards the outside wall of the conditioned space. The other discharge is directed in the opposite direction and would discharge into the interior of the conditioned space. Responsive to the temperature of the conditioned air being supplied, a thermally responsive actuator is in either one of two positions whereby either one of the two discharges in the one direction or the discharge in the opposite direction is blocked. This results in two discharges in one direction or one in each direction with the discharge area being the same in both instances.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
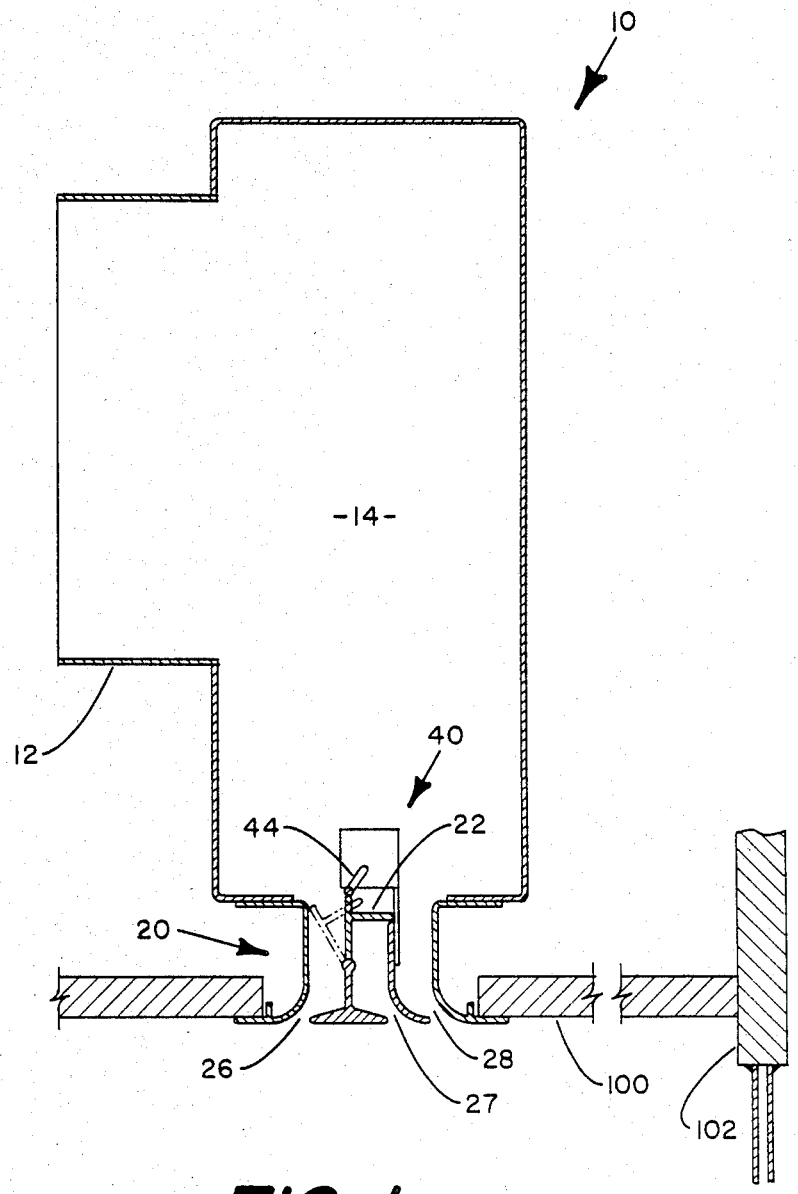
FIG. 1 is a sectional view of an air terminal employing the actuator of the present invention.

In FIG. 1, the numeral 10 generally designates an air terminal which is mounted in ceiling 100 and receives conditioned air via duct 12. The conditioned air supplied via duct 12 is delivered to plenum 14 which contains the actuator structure generally designated 40 and which is in fluid communication with the diffuser assembly 20. The diffuser assembly 20 includes a swing baffle or director 22 and three horizontal discharges 26, 27 and 28, respectively. The director 22 is illustrated in a position blocking discharge 27 whereby the conditioned air flows from discharges 26 and 28 which are in opposite directions. Director 22 is shown in phantom blocking discharge 26 whereby the conditioned air flows from discharges 27 and 28 which are in the same directions. The reason that different distribution patterns are desirable for heating and cooling is that the heating load is always located at the outside wall and the cooling load is produced both at the outside wall and in the exterior spaces by the occupants, light and machinery which are supplemental heat sources in the heating mode but additional loads in the cooling mode. Therefore, in the heating mode it is only necessary to overcome the external heating load and conditioned air is only directed towards the outside wall. In the cooling mode, however, in addition to directing the conditioned air towards the outside wall to overcome the external cooling load, it is also desirable to direct conditioned air inwardly to overcome the cooling load supplied by the occupants, machinery and lights.

Figure 2:
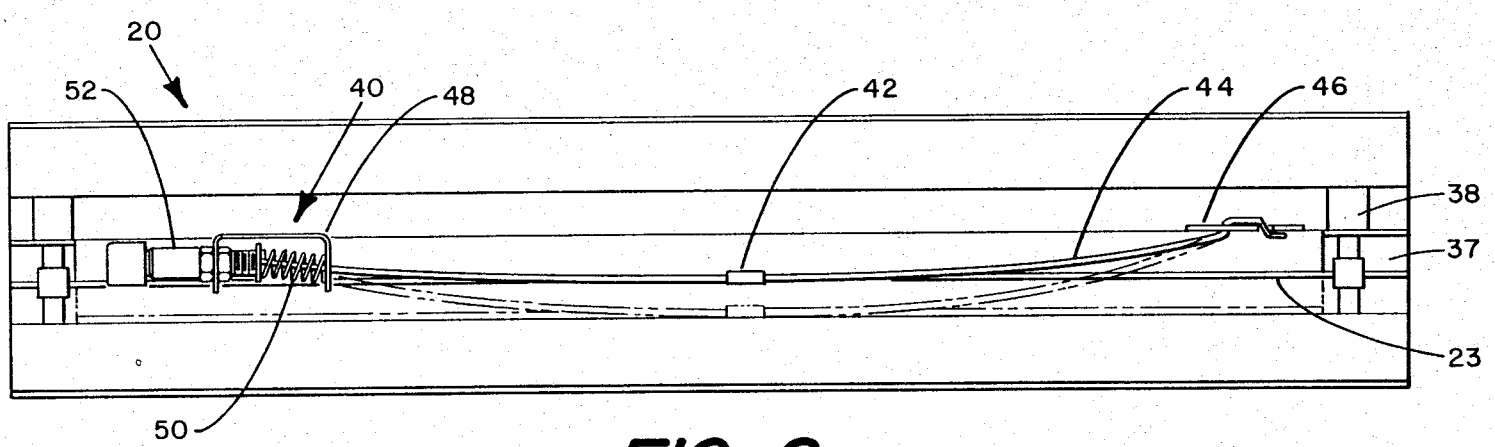
FIG. 2 is a top view of the actuator structure.
Figure 3:
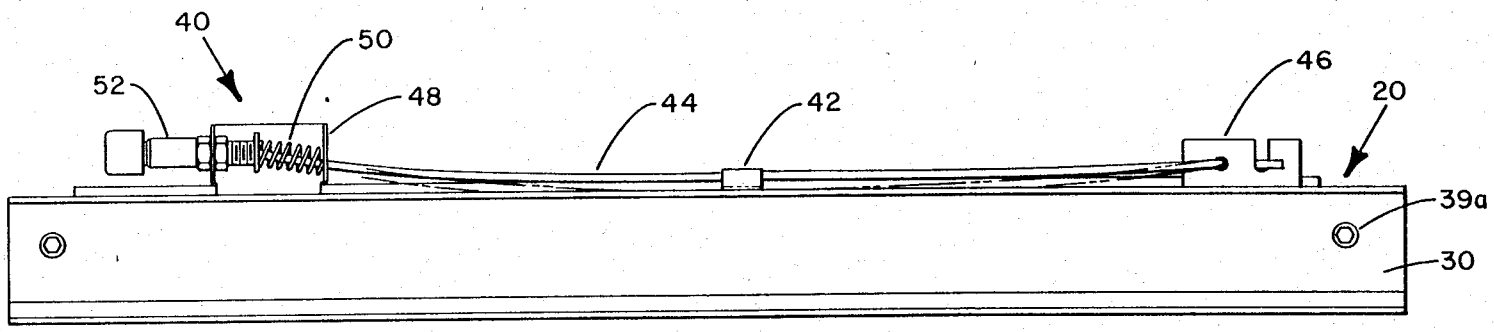
FIG. 3 is a side view of the actuator structure.
Figure 4:
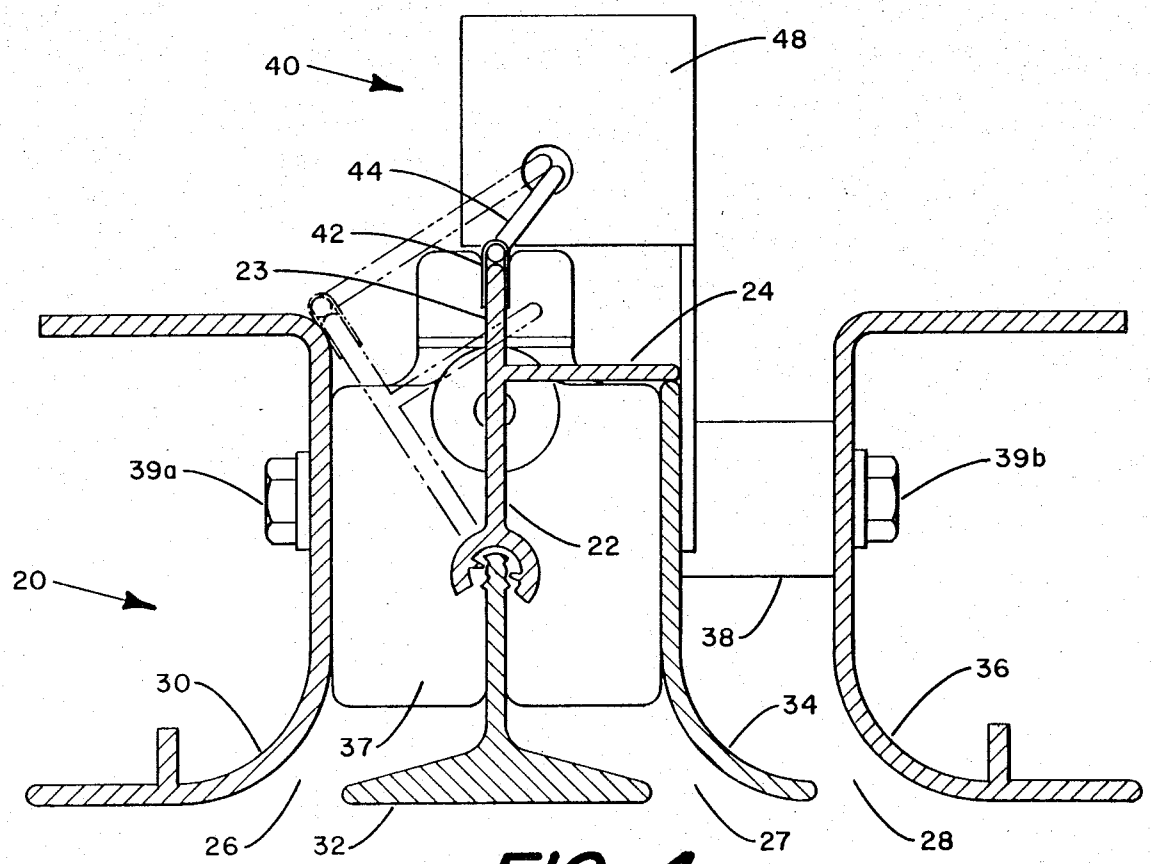
FIG. 4 is a sectional view of the diffuser employing the actuator of the present invention.

Referring now to FIGS. 2–4, the swing baffle or director 22 has a vertical arm 23 and a horizontal arm 24 which serve as valves. The vertical arm 23 is connected to the actuator structure 40 by U-clip 42. Specifically, U-clip 42 connects vertical arm 23 to rod 44. Rod 44 has one end fixedly received in wire mount 46 while the other end extends through one leg of bracket 48 and along the axis of coil spring 50 and is attached to thermoactuator 52 and is movable therewith. Thermoactuator 52 is of conventional construction and provides linear motion responsive to phase change. Coil spring 50 is compressed between thermoactuator 52 and bracket 48 to provide a return bias to the thermoactuator 52. As is clear from FIGS. 1–3, the rod 44 is not straight in any position so that the axial movement of the thermoactuator 52 produces flexure or buckling of the rod 44 rather than axial movement since one end of rod 44 is fixed by wire mount 46. This flexure of rod 44 produces rotary motion of swing baffle or director 22 causing either arm 23 or arm 24 to serve as a valve by blocking flow through discharge 26 or 27, respectively. However, this configuration permits the usage of a thermal responsive actuator while minimizing the interference with the air flow and, flexure permits suitable response over a wider range of thermoactuator movement because the shape of the flexed rod 44 can accomodate different actuation movement ranges.

As is best shown in FIG. 4, discharge 26 is defined between side diffuser 30 and center diffuser 32. Discharge 27 is defined between center diffuser 32 and center divider diffuser 34 while discharge 28 is defined between center divider diffuser 34 and side diffuser 36. A diffuser spacer 37, grommet 38 and bolts 39*a* and *b* are located at each end of the diffuser assembly 20 and secure the side diffusers 30 and 36, center diffuser 32 and center divider diffuser 34 in place.

In operation, conditioned air acts on the thermoactuator 52 of the actuator structure 40. When cool air is being supplied, the material contained in the thermoactuator 52 contracts and coil spring 50 forces the thermoactuator to contract thereby straightening and placing rod 44 in the solid line positions of FIGS. 2 and 3 and, in turn, placing swing baffle or director 22 in the solid line position of FIGS. 1 and 4, whereby arm 24 blocks discharge 27. In this position, cool air passes through discharge 28 towards the outside wall 102 and through discharge 26 towards the interior of the conditioned space where the occupants, machinery and lights provide a cooling load. If the conditioned air is switched over to heating, the heat acts on the material contained in the thermoactuator 52 causing a phase change of the material which causes the material to expand. The expansion of the material overcomes the bias of spring 50 producing linear movement of the power pill 52 which causes rod 44 to flex to the phantom line positions of FIGS. 2 and 3 since the other end of rod 44 is fixed by wire mount 46. The flexure of rod 44, in turn, causes the rotation of swing baffle or director 22 to the phantom line position of FIGS. 1 and 4, whereby arm 23 blocks discharge 26. In this position, warm air passes through discharges 27 and 28 so that all of the warm air is directed towards the outer wall 102, the only heating load.

From the foregoing it is clear that rod 44 acts as a leaf spring and the spring force combines with that of coil spring 50 to oppose the expansion movement of the thermoactuator 52 and to provide a return force to the thermoactuator when undergoing contraction due to a phase change.

Although a preferred embodiment of the present invention has been described and illustrated, other changes will occur to those skilled in the art. It is therefore intended that the present invention is to be limited only by the scope of the appended claims.

What is claimed is:

1. A thermally responsive actuator comprising:

thermally responsive means for producing linear motion by undergoing a reversible phase change;

rod means adapted to be movably secured at one end to said thermally responsive means for movement therewith and to be fixedly secured at another end so as to cause said rod means to be flexed in all positions of said thermally responsive means with the degree of flexure being determined by the position of said thermally responsive means; and means for converting flexure of said rod means into rotary motion.

2. In a diffuser means for supplying conditioned air to a space and including a plurality of discharges and pivotable means for blocking selected ones of said plurality of discharges a thermally responsive actuator comprising:

thermally responsive means for producing linear motion by undergoing a reversible phase change;

rod means having a first end secured to said thermally responsive means for movement therewith and a second end secured to said diffuser means such that said rod means is flexed in all positions of said thermally responsive means with the degree of flexure being determined by the position of said thermally responsive means; and means for connecting said rod means to said pivotable means for causing said pivotable means to pivot and block one of said selected ones of said plurality of discharges according to the temperatures of the air being supplied.

* * * * *